US007963224B2

(12) United States Patent
Barinaga et al.

(10) Patent No.: US 7,963,224 B2
(45) Date of Patent: Jun. 21, 2011

(54) DRUM HAVING A POLYMER LAYER WITH CHANNELS ON A METAL CYLINDER

(75) Inventors: Louis C. Barinaga, Vancouver, WA (US); Robert M. Yraceburu, Camas, WA (US); Stuart D. Spencer, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 957 days.

(21) Appl. No.: 11/690,804

(22) Filed: Mar. 23, 2007

(65) Prior Publication Data

US 2008/0229943 A1 Sep. 25, 2008

(51) Int. Cl.
*B41F 1/28* (2006.01)

(52) U.S. Cl. ..... 101/407.1; 101/409; 347/22

(58) Field of Classification Search ..... 101/407.1, 101/409; 271/119; 29/895–895.33; 492/56, 492/30, 32, 45; 347/22
See application file for complete search history.

(56) References Cited

U.S. PATENT DOCUMENTS

| | | | | |
|---|---|---|---|---|
| 5,099,256 | A | 3/1992 | Anderson | |
| 5,184,383 | A * | 2/1993 | Delhaes | 226/190 |
| 6,393,247 | B1 * | 5/2002 | Chen et al. | 399/330 |
| 6,568,071 | B1 | 5/2003 | Hansel et al. | |
| 6,581,517 | B1 * | 6/2003 | Becker et al. | 101/389.1 |
| 6,663,215 | B2 * | 12/2003 | Klausbruckner et al. | 347/22 |
| 6,983,692 | B2 * | 1/2006 | Beauchamp et al. | 101/409 |
| 2003/0047097 | A1 * | 3/2003 | Dzierzynski et al. | 101/368 |
| 2003/0081043 | A1 * | 5/2003 | Klausbruckner et al. | 347/22 |

FOREIGN PATENT DOCUMENTS

JP 63057440 A * 3/1988

* cited by examiner

*Primary Examiner* — Matthew G Marini

(57) ABSTRACT

Various embodiments and methods relating to a drum having a polymer layer with channels on a metal cylinder are disclosed.

19 Claims, 3 Drawing Sheets

DRUM HAVING A POLYMER LAYER WITH CHANNELS ON A METAL CYLINDER

BACKGROUND

Some printers employ a metal drum for supporting sheets during printing. Present methods for forming such drums may lack sufficient precision and accuracy or may not be cost effective.

DETAILED DESCRIPTION OF THE EXAMPLE EMBODIMENTS

Figure 1:
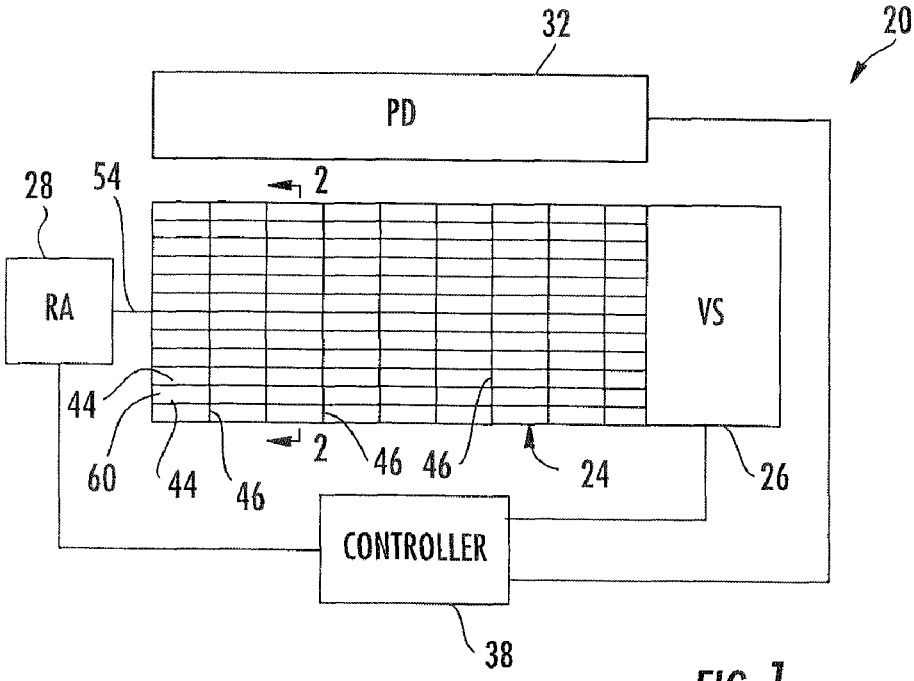
FIG. 1 is a side elevational view schematically illustrating a printing system according to an example embodiment.
Figure 2:
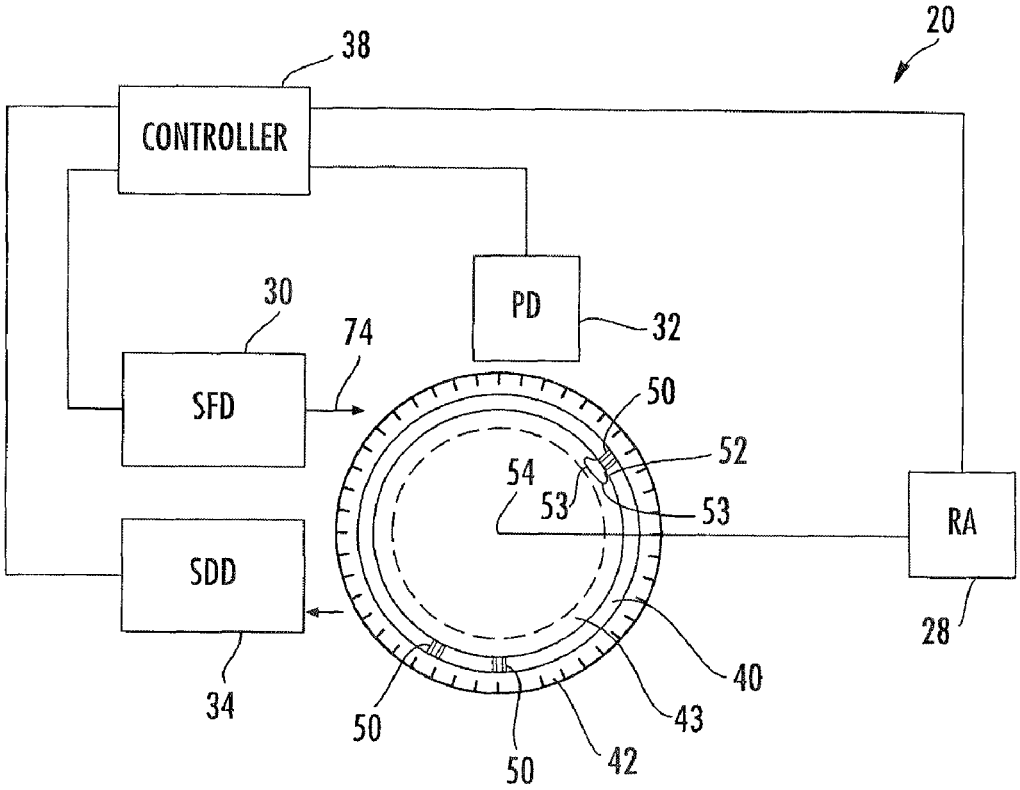
FIG. 2 is a sectional view of the printing system of FIG. 1 taken along line 2-2 according to an example embodiment.

FIGS. 1 and 2 schematically illustrate printing system 20 according to an example embodiment. Printing system 20 is configured to print images or otherwise deposit printing material upon media carried by a drum. As will be described hereafter, printing system 20 employs a drum having features that may facilitate enhanced support of media while being rigid, light weight and low-cost.

Printing system 20 includes drum 24, vacuum source 26, rotary actuator 28, sheet feed device 30, print device 32, sheet discharge device 34 and controller 38. Drum 24 comprises a generally cylindrical structure configured to support and carry sheets of media from sheet feed device 30, past print device 32 and to sheet discharge device 34. As shown by FIG. 2, a sectional view, drum 24 includes substrate 40, polymer layer 42, channels 44 and channels 46. Substrate 40 comprises a rigid cylindrical or tubular structure configured to support polymer layer 42. In the particular embodiment illustrated, substrate 40 has a circular cross-sectional shape, facilitating low-cost fabrication of substrate 40. In other embodiments, substrate 40 may be cylindrical while having other non-circular cross-sectional shapes. For example, in other embodiments, substrate 40 may include multiple circumferential facets, assisting in the retention of layer 42 circumferentially with respect to substrate 40.

In the example illustrated, substrate 40 comprises a metal cylinder. In one embodiment, substrate 40 is extruded from a metal such as aluminum. In other embodiments, other metals or alloys thereof may be used to form substrate 40. In other embodiments, other nonmetallic rigid materials may be employed to support polymer layer 42. Because substrate 40 is formed from one or more rigid materials, substrate 40 provides mechanical rigidity and stability for supporting layer 42, inhibiting warpage and shrinkage of layer 42.

Polymer layer 42 comprises one or more layers of one or more polymers extending adjacent to and in contact with substrate 40. Because layer 42 is formed from one or more polymers, layer 42 is lighter in weight as compared to metals.

Such weight savings facilitate better control of drum motion and feed accuracy by system 20.

According to one embodiment, layer 42 is formed from one or more polymer materials which have thermal coefficients of expansion approximating that of aluminum for enhanced stability. In one embodiment, layer 42 is formed from one or more polymers having low moisture absorption, good chemical resistance, static dissipative, dimensionally stable, and creep resistant. Examples of polymers from which layer 42 may be formed include, but are not limited to, polyphenylene ether/polystyrene, polycarbonate, polyetherimide polyphenylene pulfide, Acrylonitrile butadiene styrene (ABS), or polyethylene perephthalate.

In the example embodiment illustrated, layer 42 has a thickness of between about 1 mm and about 5 mm, and nominally about 3 mm from the exterior surface of a substrate 40 to the floor of channels 46. In one embodiment, layer 42 has a thickness extending from the exterior surface of substrate 40 to an outermost exterior surface of layer 42 of between about 2 mm and about 8 mm. In other embodiments, depending upon the one or more polymers from which layer 42 is formed, layer 42 may have other thicknesses.

Because layer 42 is formed from one or more polymers, channels 44 and 46 may be formed in layer 42 in less time and at a lower cost as compared to forming such channels in a metal layer, such as with machining. In particular, layer 42 may be molded so as to concurrently form layer 42 and channels 44, 46. Channels 44, 46 may be provided with highly accurate, small and complex geometries in layer 42. In one embodiment, layer 42 is injection molded or over molded about substrate 40, reducing assembly time and cost and facilitating more secure retention of layer 42 to substrate 40.

As indicated with broken lines in FIG. 2, in one embodiment, drum 24 may be additionally provided with interior layer 43. In one embodiment, layer 43 is connected to layer 42. As a result, layer 43 further assists in retaining layer 42 relative to substrate 40. In some embodiments, layer 42 is retained relative to substrate 40 by such mechanical retention such that adhesive or chemical bonding between layer 42 and substrate 40 may be reduced or eliminated. Because layer 42 may be retained relative to substrate 40 with reduced or no adhesive bonding, layer 42 A. be formed from a wider range of one or more polymer materials. In one embodiment, layers 42 and 43 substantially surround or encapsulate substrate 40, potentially reducing erosion or damage to substrate 40. In one embodiment, layers 42 and 43 may be connected to one another along axial ends of substrate 40. In another embodiment, layers 42 and 43 may be connected to one another through openings or passages 50 through the wall of substrate 40.

According to one embodiment, layers 42 and 43 are formed with an injection molding process. As a result, layers 42 and 43 are integrally formed as a single unitary body, reducing or avoiding the need for additional fasteners between layers 42 and 43. In one embodiment, layer 42 and 43 are integrally joined to one another by the one or more polymers forming such layers extending around and across axial ends of substrate 40. In another embodiment, substrate 40 may be provided with passages or openings 50 (two of which are shown in broken lines) extending through substrate 40 in a substantially radial direction, wherein the polymer material or materials forming layers 42 and 43 are injected through the openings to integrally connect layers 42 and 43. In such an embodiment, layers 42 and 43 may be integrally joined to one another at a multiple of locations between the axial ends a substrate 40 providing enhanced retention of layer 42 along the exterior of drum 24. In yet other embodiments, layers 42 and 43 may be integrally connected to one another as a single unitary body by extending through both openings 50 and around axial ends of substrate 40.

According to one embodiment, layer 43 may extend along and entire axial length of substrate 40 and along substantially an entirety of the circumferential interior surface of substrate 40. In another embodiment, layer 43 may extend along limited portions of the interior surface of a substrate 40, such as adjacent to and about openings 50 and/or adjacent to axial ends of substrate 40. In some embodiments, layer 42 may be omitted.

In other embodiments, layer 42 may be secured to substrate 40 using other mechanical interlocks, such as T-shaped anchors 52 projecting from layer 42 that extend through openings 50 in substrate 40 and that engage the interior surface or backside of substrate 40. For example, such anchors 52 may have resiliently flexible ends 53 that flex or bend during insertion through openings 50 and that pop out to retain layer 42 and substrate 40. In one embodiment, anchors 52 may be integrally formed as part of a single unitary body with layer 42. In yet other embodiments, anchors 52 may have other configurations and may be secure to layer 42 in other fashions, such as being molded into layer 42. In such embodiments, layer 42 may alternatively be formed independent of substrate 40 and subsequently positioned or wrapped about substrate 40 with such mechanical interlocking projections being passed through openings 50 to snap layer 42 onto substrate 40 for retaining layer 42 against substrate 40.

Channels 44 and 46 comprise depressions extending into and along an exterior surface of layer 42. Channels 44 and 46 are configured to pneumatically connect exterior surface areas of layer 42 with vacuum source 26. Vacuum pressure is applied through channels 44 and 46 to sheets of media on layer 42 to assist in retaining the one or more sheets against layer 42 as drum 24 is rotationally driven about axis 54. Because layer 42 is formed from one or more polymer materials, channels 44 and 46 may be provided with more complex and sharper, well-defined geometries for enhanced application of vacuum pressure to sheets held against layer 42. At the same time, such channels 44 and 46 may be more easily fabricated at a lower cost as compared to metal drums which are sometimes machined.

As shown by the particular example illustrated in FIG. 1, channels 44 (sometimes referred to as pockets) extend substantially parallel to one another axially along layer 42 and drum 24. Channels 44 are circumferentially spaced apart from one another by axially extending ribs 60. Ribs 60 further axially space channels 46 from one another. According to one embodiment, each of channels 44 has the same depth and the same circumferential width. For example, in one embodiment, channels 44 each have circumferential width of between about 4 mm and about 6 mm and nominally five millimeters. Ribs 60, circumferentially extending between channels 44, each have a circumferential width of between about 0.25 mm and about 3 mm, and nominally about 1 mm. Channels 44 have a depth of between about 0.5 mm to 4 mm and nominally about 1 mm. Such dimensions provide enhanced retention of sheets along the surface of drum 24 using vacuum pressure supplied by vacuum source 26. In other embodiments, channels 44 may have different dimensions. In other embodiments, distinct portions of drum 24 may have distinct channels 44 with distinct dimensions.

According to one embodiment, drum 24 includes a plurality of distinct circumferential regions along its outer surface. Each circumferential region has channels 44 that are each parallel to one another (i.e. some of channels 44 in each region not being perfectly radial with respect to axis 54). For example, in one embodiment, drum 24 includes four circumferential regions, each region extending substantially 90 degrees about axis 54. Each of such regions includes a set of circumferentially spaced channels 44 that are substantially parallel to one another. In another embodiment, drum 24 may include 8 circumferential regions, each region extending substantially 45 degrees about axis 54, wherein each of such regions includes a set of circumferentially spaced channels 44 that are substantially parallel to one another. In other embodiments, drum 24 may include a greater or fewer of such circumferential regions, wherein the channels 44 of each region extend substantially parallel to one another. Because channels 44 of each region extend substantially parallel to one another, channels 44 are more easily fabricated into layer 42. For example, such configurations of channels 44 facilitates molding of channels 44 into layer 42 using multiple slides having channel forming projections, wherein the slides move radially with respect to substrate 40 during molding of layer 42.

Channels 46 circumferentially extend around drum 24. According to one embodiment, channels 46 are uniformly spaced from one another in an axial direction along a drum 24. In other embodiments, distinct portions of drum 24 may have channels 46 that are axially spaced from one another by different distances. According to one embodiment, channels 46 are axially spaced apart from one another by ribs 60 which have an axial length of between about 12 mm (0.5 inches) and 250 mm (10 inches), depending on media sizes supported. According to one embodiment, channels 46 have axial width of between about 2 mm and about 8 mm, and nominally about 5 mm. Channels 46 have a depth of between about 2 mm and about 8 mm, and nominally about 5 mm. Such dimensions enhance vacuum retention of sheets along the surface of drum 24. In other embodiments, channels 46 may have other dimensions. In some embodiments, distinct portions of drum 24 may have channels 46 with distinct dimensions concert as distinct depths or distinct axial widths.

Vacuum source 26 comprises a source of vacuum pressure pneumatically coupled to channels 44 and 46 of drum 24. The term "pneumatically coupled" means that vacuum source 26 is connected to the interior of channels 44 and 46 by one or more passages through which air or other gas may flow. Vacuum source 26 applies a vacuum through channels 44 and 46 to draw and retain one or more sheets of media against the exterior surface of a layer 42. In one embodiment, vacuum source 26 may be pneumatically connected to channels 44, wherein vacuum source 26 is pneumatically coupled to channels 46 by channels 44. In one embodiment, vacuum source 26 is configured to selectively apply a vacuum pressure to selected channels 44 and/or selected channels 46. Although vacuum source 26 is illustrated as being located on an axial end of drum 24, in other embodiments, vacuum source 26 may alternatively be located within an interior of drum 24.

Rotary actuator 28 comprises a device configured to rotationally drive drum 24 about axis 54. Such rotation moves sheets of media held by drum 24 from sheet feed device 30, to print device 32 and subsequently to sheet discharge device 34. In one embodiment, rotary actuator 28 may comprise a motor operably coupled to drum 24 by a power train or transmission. In other embodiments, rotary actuator 28 may comprise other devices configured to rotate drum 24.

Sheet feed device 30 comprises a device or mechanism configured to position sheets of media onto and against an exterior surface of drum 24 as indicated by arrow 74. In one embodiment, sheet feed device 30 is configured to withdraw sheets from a sheet supply, such as a tray or bin and to transfer or position such sheets against layer 42 over some of channels 44 and 46. In one embodiment, sheet feed device 30 is configured to hold such sheets against layer 42 until a vacuum is applied to the sheet being positioned.

Print device 32 comprises a device configured to form one or more images upon sheets of media held by drum 24. In one embodiment, print device 32 comprises one or more drop-on-demand ink jet print heads configured to eject ink or other fluid onto media held by drum 24. For example, in one embodiment, print device 32 may comprise a page-wide-array of one or more print heads which are stationary supported opposite to drum 24. In another embodiment, print device 32 may comprise one or more print heads supported by a carriage configured to actually move or scan along drum 24. In yet other embodiments, print device 32 may comprise other devices configured to deposit printing material upon media held by drum 24 or to otherwise interact with media held by drum 24 to form one or more images or patterns upon the media.

Sheet discharge device 34 comprises a device or mechanism configured to extract or withdraw printed upon sheets of media from the drum 24. In one embodiment, sheet discharge device 34 is configured to further transfer such withdrawn or discharged sheets to an output tray or output bin. In yet another embodiment, sheet discharge device 34 may be configured to overturn such sheets while transmitting such sheets back to sheet feed device 34 duplex or 2-sided printing.

Controller 38 comprises one or more processing units configured to generate control signals to direct the operation of rotary actuator 28, sheet feed device 30, print device 32 and sheet discharge device 34. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 38 may be embodied as part of one or more application-specific integrated circuits (ASICs). Unless otherwise specifically noted, the controller is not limited to any specific combination of hardware circuitry and software, nor to any particular source for the instructions executed by the processing unit.

In operation, according to one embodiment, controller 38 generates control signals directing sheet feed device 30 to position a sheet of media against the exterior surface of drum 24. Controller 38 further generates control signals directing vacuum source 26 to apply a vacuum to such sheets through channels 44 and 46 of drum 24. Rotary actuator 28, in response to control signals from controller 38, rotates drum 24 to move the sheet to a position opposite to print device 32. Print device 32 forms an image or pattern onto the sheet held by drum 24. Because layer 42 facilitates the forming of channels 44 and 46 which have more controlled and precisely shaped features, sheets may be more reliably held against drum 24 for enhanced positional accuracy which may result in improved print quality. After the sheet has been printed upon, controller 38 generates control signals further directing rotary actuator 28 to rotate drum 24 to move the sheet to sheet discharge device 34. Sheet discharge device 34 removes the sheet from drum 24.

Overall, drum 24 affords several benefits. As compared to machined drums, drum 24 is less expensive. Drum 24 may be revised or altered, prototyped and mass-produced in shorter times. Drum 24 experiences enhanced rigidity, weight savings and reduced thermal patterning. In those embodiments including both layers 42 and 43, drum 24 provides the ability to form functional features on both the inside and the outside of drum 24. Because layer 42 is formed from one or more polymers, layer 42 has a better chemical compatibility and may be provided with tight tolerances. Because layer 42 is formed from one or more polymers, properties of drum 24 may be selectively chosen to address particular issues in a particular applications or printing environments. Examples of variables that may be adjusted on drums for particular applications include, but are not limited to: color, texture, coefficient of thermal expansion, thermal conductivity, electrical conductivity, lubricity, surface tension, corrosion resistance and stiffness. Substrate 40 rigidifies layer 42 to further provide drum 24 with enhanced creep tolerance, reduced water absorption or swelling, durability and reduced shrinkage or warpage.

Figure 3:
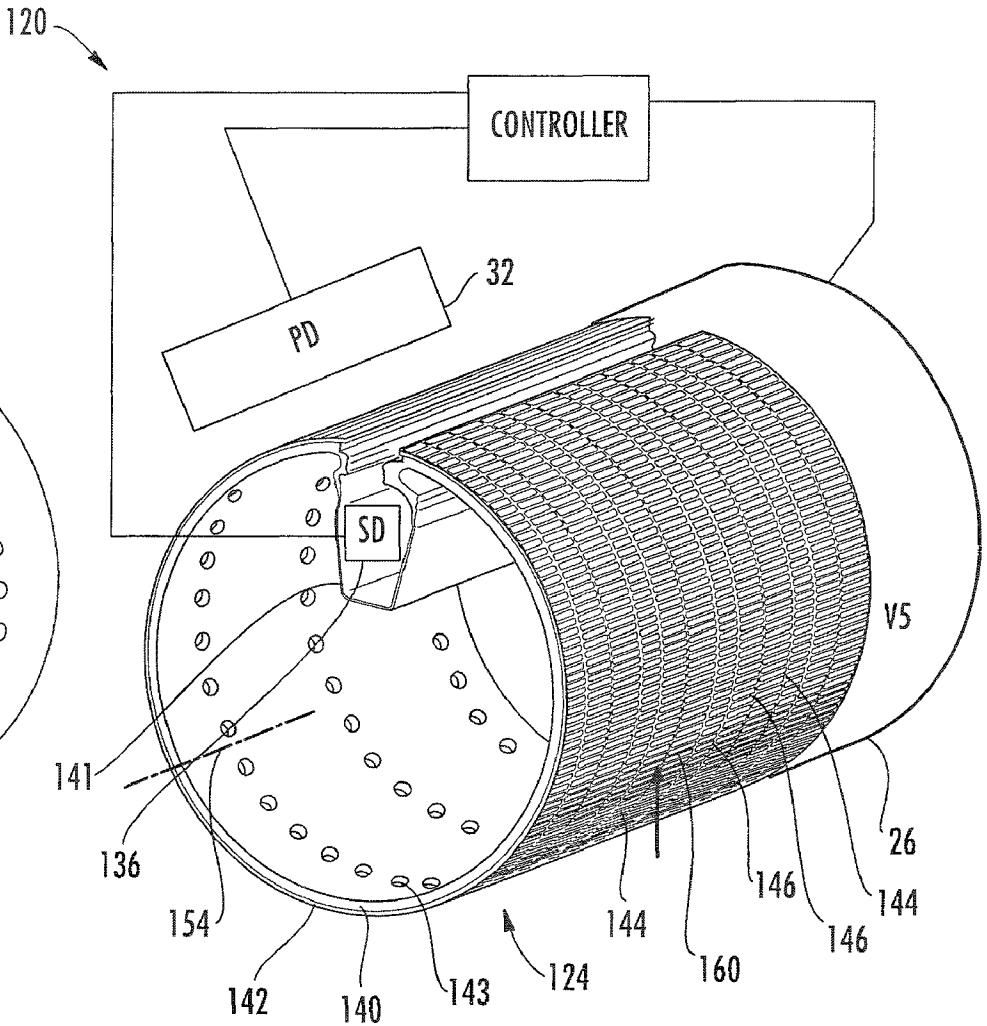
FIG. 3 is a perspective view of another embodiment of the printing system of FIG. 1 with portions schematically shown according to an example embodiment.

FIG. 3 illustrates printing system 120, another embodiment of printing system 20 shown in FIGS. 1 and 2. Printing system 120 includes drum 124, vacuum source 26, rotary actuator 28 (shown in FIG. 1), sheet feed device 30 (shown in FIG. 2), print device 32, sheet discharge device 34 (shown in FIG. 2) and service device 136. Printing system 120 is similar to printing system 20 except that printing system 120 includes drum 124 in lieu of drum 24 and is additionally illustrated as including service device 136. Vacuum source 26, rotary actuator 28, sheet feed device 30, print device 32 and sheet discharge device 34 are each described above with respect to printing system 20.

Figure 4:
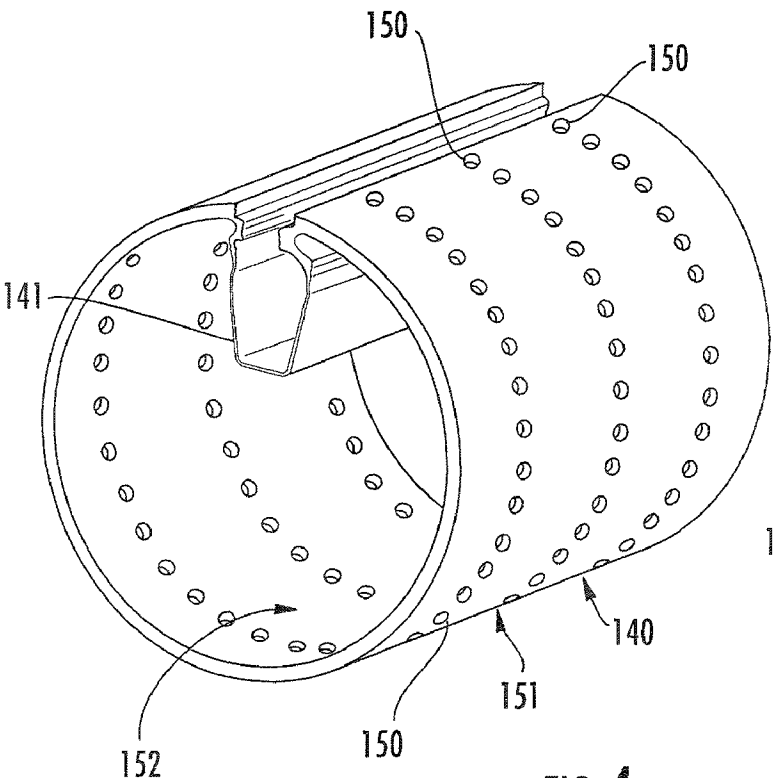
FIG. 4 is a perspective view of a substrate and service chamber of the printing system of FIG. 3 according to an example embodiment.

Like drum 24, drum 124 is configured to support and carry sheets of media held against its exterior surface by a vacuum applied by vacuum source 26. Drum 124 includes substrate 140, service chamber 141, polymer layer 142, interior layer 143 and channels 144, 146. FIG. 4 illustrates substrate 140 and service chamber 141 without polymer layer of 142, interior layer 143 or channels 144, 146. As shown by FIG. 4, substrate 140 comprises a rigid cylindrical or tubular structure configured to support polymer layer 142. In the particular embodiment illustrated, substrate 140 has a circular cross-sectional shape, facilitating low-cost fabrication of substrate 140. In other embodiments, substrate 140 may be cylindrical while having other non-circular cross-sectional shapes. For example, in other embodiments, substrate 140 may include multiple circumferential facets, assisting in the retention of layer 142 circumferentially with respect to substrate 140.

In the example illustrated, substrate 140 comprises a metal cylinder. In one embodiment, substrate 140 is extruded from a metal such as aluminum. In other embodiments, other metals or alloys thereof may be used to form substrate 140. In other embodiments, other nonmetallic rigid materials may be employed to support polymer layer 142. Because substrate 140 is formed from one or more rigid materials, substrate 140 provides mechanical rigidity and stability for supporting layer 142, inhibiting warpage and shrinkage of layer 142.

As further shown by FIG. 4, substrate 140 includes a multitude of spaced openings 150 extending through substrate 140. Openings 150 are configured to facilitate mechanical connection of layers 142 and 143. In the particular example illustrated, openings 150 facilitate flow of polymer material from the exterior 151 of substrate 140 to the interior 152 of substrate 140. As a result, openings 150 facilitate integral formation a layers 142 and 143 to at least partially encapsulate substrate 140 and to retain layer 142 against exterior 151 of substrate 140 using layer 143.

In the particular embodiment illustrated, openings 150 are uniformly distributed across substrate 140 such that layer 142 is uniformly held or retained against substrate 140. As a result, stresses upon layer 142 are uniformly distributed across layer 142. In other embodiments, openings 150 may be irregularly located or non-uniformly spaced with respect to one another along substrate 140.

In one embodiment, openings 150 each radially extend through substrate 140. In one embodiment, each opening 150 has a diameter of between about 2 mm and about mm, and nominally about 4 mm. In one embodiment, openings 150 are circumferentially spaced from one another by distance of between about 20 mm and about 150 mm, and nominally about 60 mm. In one embodiment, such openings 150 are axially spaced from one another by distances of between about 20 mm and about 150 mm and nominally about 60 mm. In other embodiments, openings 150 may have other dimensions, may extend through substrate 140 along other paths and may have other regular or irregular patterns along substrate 140.

In other embodiments, openings 150 may alternatively be configured to facilitate mechanical connection of layers 142 and 143. For example, openings 150 may alternatively be located and sized such that fasteners may be located within openings 150 while joining layers 142 and 143. In still other embodiments, openings 150 may be omitted.

Service chamber 141 comprises an elongate cavity extending parallel to the axis 154 of drum 124 and radially opening through substrate 140. Service chamber 141 provides a volume for receiving service device 136 (shown in FIG. 3) radially inward from an exterior of drum 124 along an axial length of drum 124. As a result, service device 136 may service print device 32 while print device 32 remains positioned between axial ends of drum 124. In other embodiments where service device 136 is located on an axial end of drum 124, service chamber 141 may be omitted. In such an embodiment, substrate 140 may continuously extend about its axis.

In one embodiment, service chamber 141 is formed by one or more walls integrally formed as a single unitary body with the walls of substrate 140. In one embodiment, the walls of service chamber 141 are co-extruded with the walls of substrate 140. In other embodiments, service chamber 141 may be bonded, welded, fastened or otherwise adhered to substrate 140.

Polymer layer 142 comprises one or more layers of one or more polymers extending adjacent to and in contact with substrate 140. Because layer 142 is formed from one or more polymers, layer 142 is lighter in weight as compared to metals. Such weight savings facilitate better control of drum motion and feed accuracy by system 120.

According to one embodiment, layer 142 is formed from one or more polymer materials which have thermal coefficients of expansion approximating that of aluminum for enhanced stability. In one embodiment, layer 142 is formed from one or more polymers having low moisture absorption, good chemical resistance, static dissipative, dimensionally stable, and creep resistant. Examples of polymers from which layer 142 may be formed include, but are not limited to, polyphenylene ether/polystyrene, polycarbonate, polyetherimide polyphenylene sulfide, ABS, or polyethylene terephthalate.

In the example embodiment illustrated, layer 142 has a thickness of between about 1 mm and about 5 mm, and nominally about 3 mm from the exterior surface of a substrate 40 to the floor of channels 146. In one embodiment, layer 142 has a thickness extending from the exterior surface of substrate 140 to an outermost exterior surface of layer 142 of between about 2 mm and about 8 mm. In other embodiments, depending upon the one or more polymers from which layer 142 is formed, layer 142 may have other thicknesses.

Because layer 142 is formed from one or more polymers, channels 144 and 146 may be formed in layer 142 in less time and at a lower cost as compared to forming such channels in a metal layer, such as with machining. In particular, layer 142 may be molded so as to concurrently form layer 142 and channels 144, 146. Channels 144, 146 may be provided with highly accurate, small and complex geometries in layer 142. In one embodiment, layer 142 is injection molded or over molded about substrate 140, reducing assembly time and cost and facilitating more secure retention of layer 142 to substrate 140.

Interior layer 143 is connected to layer 42 at least through openings 150. As a result, layer 43 further assists in retaining layer 42 relative to substrate 40. As a result, layer 142 is retained relative to substrate 140 by such mechanical retention such that adhesive or chemical bonding between layer 142 and substrate 140 may be reduced or eliminated. Because layer 142 may be retained relative to substrate 140 with reduced or no adhesive bonding, layer 142 may be formed from a wider range of one or more polymer materials. In one embodiment, layers 142 and 143 substantially surround or encapsulate substrate 140, potentially reducing corrosion or damage to substrate 140. In one embodiment, layers 142 and 143 may be additionally or may be alternatively connected to one another along axial ends of substrate 140.

According to one embodiment, layers 142 and 143 are formed with an injection molding process. As a result, layers 142 and 143 are integrally formed as a single unitary body, reducing or avoiding additional fasteners between layers 142 and 143. In one embodiment, layer 142 and 143 are integrally joined to one another by the one or more polymers forming such layers extending around and across axial ends of substrate 140. In the embodiment illustrated, the polymer material or materials forming layers 42 and 43 are injected through the openings to integrally connect layers 42 and 43. As a result, layers 142 and 143 are integrally joined to one another at multiple locations between the axial ends of substrate 40, providing enhanced retention of layer 142 along the exterior of drum 124. In yet other embodiments, layers 142 and 143 may be integrally connected to one another as a single unitary body by extending through both openings 150 and around axial ends of substrate 140.

According to one embodiment, layer 143 may extend along an entire axial length of substrate 140 and along substantially an entirety of the circumferential interior surface of substrate 140. In another embodiment, layer 143 may extend along limited portions of the interior surface of a substrate 140, such as adjacent to and about openings 150 and/or adjacent to axial ends of substrate 140. In some embodiments, layer 142 may be omitted.

Channels 144 and 146 comprise depressions extending into and along an exterior surface of layer 142. Channels 144 and 146 are configured to pneumatically connect exterior surface areas of layer 142 with vacuum source 126. Vacuum pressure is applied through channels 144 and 146 to sheets of media on layer 142 to assist in retaining the one or more sheets against layer 142 as drum 124 is rotationally driven about axis 154. Because layer 142 is formed from one or more polymer materials, channels 144 and 146 may be provided with more complex and sharper, well-defined geometries for enhanced application of vacuum pressure to sheets held against layer 142. At the same time, such channels 144 and 146 may be more easily fabricated at a lower cost as compared to metal drums which are sometimes machined.

As shown by the particular example illustrated in FIG. 3, channels 144 (sometimes referred to as pockets) extend substantially parallel to one another axially along layer 142 and drum 124. Channels 144 are circumferentially spaced apart from one another by axially extending ribs 160. Ribs 160 further axially space channels 146 from one another. According to one embodiment, each of channels 144 has the same depth and the same circumferential width. For example, in one embodiment, channels 144 each have circumferential width of between about 4 mm and about 6 mm and nominally five millimeters. Ribs 60 circumferentially extending between channels 44 each have a circumferential width of between about 0.25 mm and about 3, and nominally about 1 mm. Channels 144 have a depth of between about 0.5 to 4 mm and nominally about 1 mm. Such dimensions provide enhanced retention of sheets along the surface of drum 124 using vacuum pressure supplied by vacuum source 26. In other embodiments, channels 144 may have different dimensions. In other embodiments, distinct portions of drum 124 may have distinct channels 144 with distinct dimensions.

In the embodiment illustrated, drum 124 includes a plurality of distinct circumferential regions along its outer surface. Each circumferential region has channels 144 that are each parallel to one another (i.e. some of channels 144 in each region not being perfectly radial with respect to axis 154). For example, in one embodiment, drum 124 includes four circumferential regions, each region extending substantially 90 degrees about axis 154. Each of such regions includes a set of circumferentially spaced channels 144 that are substantially parallel to one another. In another embodiment, drum 124 may include 8 circumferential regions, each region extending substantially 45 degrees about axis 154, wherein each of such regions includes a set of circumferentially spaced channels 144 that are substantially parallel to one another. In other embodiments, drum 124 may include a greater or fewer of such circumferential regions, wherein the channels 144 of each region extend substantially parallel to one another. Because channels 144 of each region extend substantially parallel to one another, channels 144 are more easily fabricated into layer 142. For example, such configurations of channels 144 facilitates molding of channels 144 into layer 142 using multiple slides having channel forming projections, wherein the slides move radially with respect to substrate 140 during molding of layer 142.

Channels 146 circumferentially extend around drum 124. According to one embodiment, channels 146 are uniformly spaced from one another in an axial direction along a drum 124. In other embodiments, distinct portions of drum 124 may have channels 146 that are axially spaced from one another by different distances. According to one embodiment, channels 146 are axially spaced apart from one another by ribs 160 which have an axial length of between about 12 mm (0.5 inches) and 250 mm (10 inches), depending on media sizes supported. According to one embodiment, channels 46 have axial width of between about 2 mm and about 8 mm, and nominally about 5 mm. Channels 46 have a depth of between about 2 mm and about 8 mm, and nominally about 5 mm. Such dimensions enhance vacuum retention of sheets along the surface of drum 124. In other embodiments, channels 146 may have other dimensions. In some embodiments, distinct portions of drum 124 may have channels 46 with distinct dimensions, distinct depths or distinct axial widths.

Service device 136 is schematically illustrated in FIG. 3. Service device 136 comprises a device configured service print device 32 while print device 32 is located between axial ends of drum 124. In one embodiment in which print device 32 includes nozzles, service device 136 comprises a device configured to assist with one or more of capping, wiping or spitting of the inkjet nozzles. In other embodiments, depending upon the nature of print device 32, service device 136 may be configured to form other servicing operations. In one embodiment, service device 136 is positioned stationary within service chamber 141. In yet other embodiments, service device 136 may be coupled to a motor or linear actuator configured to linearly move or translate service device 136 along and within service chamber 141 parallel to axis 154. In some embodiments, service device 136 may be additionally operably coupled to other actuators configured to radially move service device 136 towards and away from the exterior of drum 124 for selective engagement and disengagement with print device 32. In still other embodiments, service device 136 may be omitted.

As with printing system 20 which includes drum 24, printing system 120 may provide several benefits as a result of its use of drum 124. Because layer 142 is made from a polymer material, drum 124 may be lighter in weight lowering costs and providing enhanced positional control of drum 124. Because drum 124 may be less expensive to fabricate, the cost of printing system 120 may be lower. Because channels 144 and 146 may be molded into layer 142, channels 144 and 146 may be provided with greater definition and enhanced geometries for them enhanced retention of sheets along from 124, potentially improving print quality.

Figure 5:
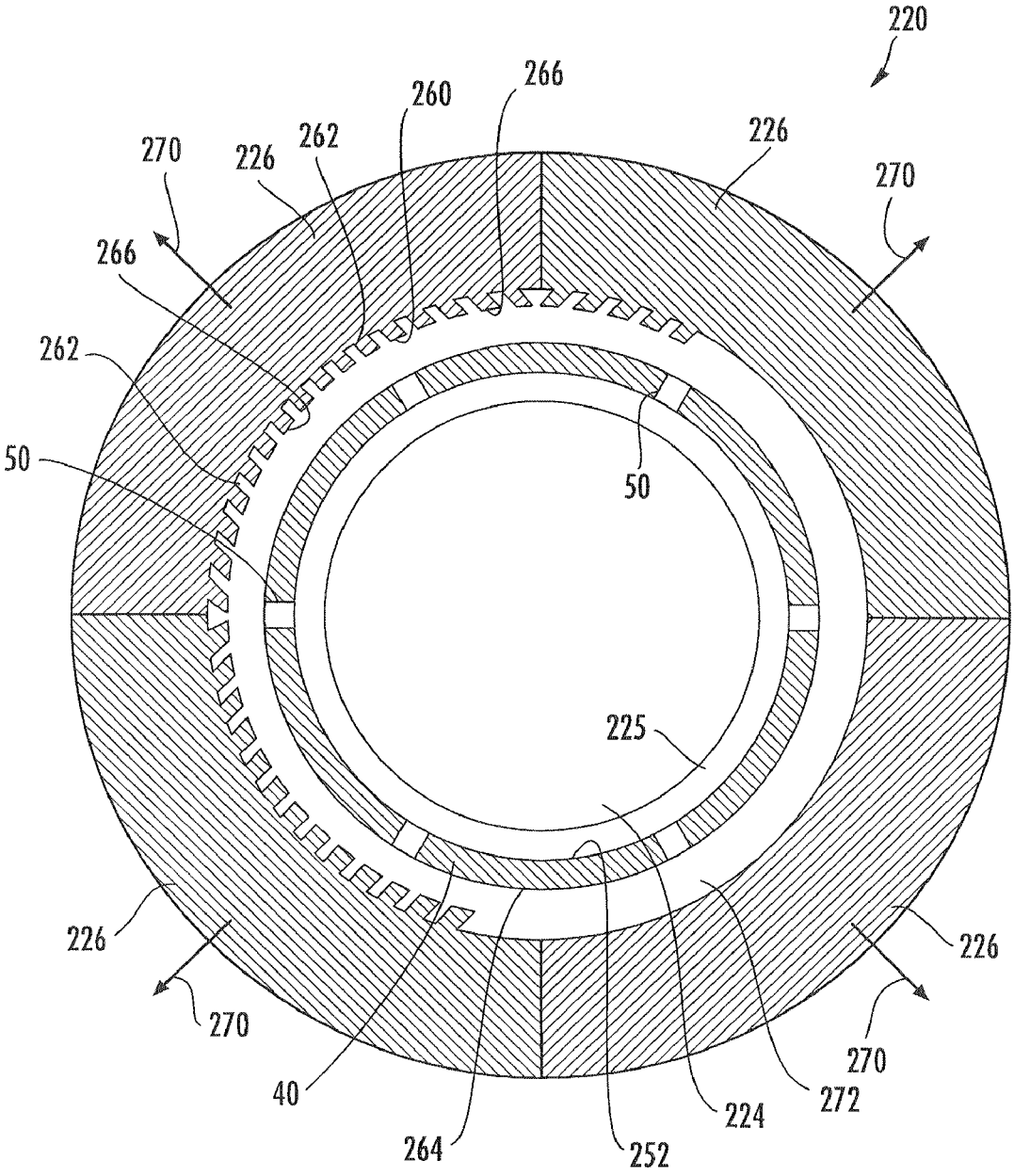
FIG. 5 is a sectional view schematically illustrating an apparatus and method for forming a drum of the printing system of FIG. 1 or FIG. 3 according to an example embodiment.

FIG. 5 schematically illustrates one example apparatus 220 and method for forming either drum 24 or drum 124. For ease of discussion, apparatus 220 is described as part of a method or process for forming drum 24 (shown and described with respect to FIGS. 1 and 2). In the example shown, substrate 40 includes a multitude of spaced openings 50 through which polymer material flows during molding of layers 42 and 43. In other embodiments, apparatus 220 may be used, with slight modifications to accommodate service chamber 141, to form drum 124 (shown and described with respect to FIG. 3).

As shown by FIG. 5, apparatus 220 includes core 224 and circumferential die segments or slides 226. Core 224 comprises elongate cylindrical member or pin configured to be positioned within substrate 40 during molding of layers 42 and 43. Core 224 is configured such that the exterior of core 224 is radially spaced from interior 252 of substrate 40. The radial spacing or gap 225 defines a thickness of layer 43. In one embodiment, core 224 has a uniform spacing with respect to interior 252 of substrate 40 during molding such that layer 43 has a uniform thickness. In other embodiments, core 224 may have an irregular surface such that molded layer 43 has irregular thicknesses or, in certain portions of drum 24, is omitted.

Core 224 has an exterior surface which defines the interior of drum 124. In one embodiment, core 224 is formed from hardened tool steel. In other embodiments, core 224 may be formed from one or more other materials. In one embodiment, core 224 is configured to be removed after molding of layers 42 and 43. In yet another embodiment, core 224 is configured to be collapsed, broken or otherwise disassembled after molding.

Slides 226 comprise structures movable with respect to core 224 that are configured to mold layer 42 and channels 44 and 46 which extend into layer 42. In the example embodiment illustrated, slides 226 are substantially similar to one another. Each slide 226 is movably supported with respect to core 224 by a frame and associated bearings (not shown) so as to be movable radially with respect to core 224. In one embodiment, linear actuators such as solenoids or hydraulic or pneumatic cylinders may be used to move slides 226 radially towards and away from core 224 and substrate 40 extending about core 224.

As further shown by FIG. 5, each slide 226 has an interior arcuate face 260 opposite to substrate 40. Each face 260 includes a multitude of recesses 262 which radially project away from core 224 and which define ribs 60 which, in turn, define channels 44 and 46 in the polymer layer formed between face 260 and exterior 264 of substrate 40. Portions of face 260 between recesses 262 form projections 266 which form channels 44 and 46. According to one embodiment, recesses 262 and projections 266 of each slide 226 extend parallel to one another and parallel to the linear axis 270 along which slides 226 move towards and away from core 224 and substrate 40. For example, in one embodiment, the center most recesses 262 and the center most projections 266 may extend radially with respect to the centerline of core 224. A remainder of recesses 262 and projections 266 on both sides of the center most recess 262 and projection 266 extend parallel to the center most recess 262 and projection 266 rather than radially extending from the axis of core 224. As a result, after molding of channels 44 and 46 in layer 42, slides 226 may be more easily radially withdrawn along axes 270 and better control of the geometry of channels 44 and 46 may be achieved.

Each slide 226 extends around an angular portion or extent of core 224 such that slides 226, collectively, circumscribe substantially an entirety of core 224 while being spaced from core 224 by a gap 272. In the particular example illustrated, apparatus 220 includes four slides, each slide extending about 90 degree of core 224. In such embodiments, increasing the number of slides 226 may also result in a greater percentage of channels 44 radially projecting with respect to the axis of core 224 and the molded drum 24. Increasing the number of slides 226 will also result in channels 44 extending along axes or in directions more closely approximating radial directions with respect to the axis of core 224 and the resulting drum 24. Although FIG. 5 illustrates four slides 226, in other embodiments, apparatus 220 may include a greater number of slides. For example, in another embodiment, apparatus 220 may include 8 slides or 16 slides. In other embodiments, apparatus 220 may he provided with fewer slides 226.

In the process of forming drum 24, substrate 40 is first provided and is supported along axes 54 of the drum 24 to be formed. Core 224 is positioned within substrate 40 in spaced relationship to interior 252 of substrate 40. Each of slides 226 is positioned about substrate 40 and spaced relationship to exterior 264 of a substrate 40. Each of slides 226 is positioned such that slides 226 collectively circumscribe substrate 40. Thereafter, one or more polymer materials are injected into one or both of gaps 225 and 272 until gap 272 is substantially filled with the one or more polymer materials and until a sufficient extent of interior 252 of substrate 40 is coated with the one or more polymer materials to retain the resulting layer 42 against substrate 40 as a result of the layer 43 extending through openings 50 and being joined to layer 42.

Upon forming of layers 42 and 43 and upon the one or more polymer materials (and potentially one or more fillers) sufficiently solidifying, hardening or curing, slides 226 are drawn away from core 224 along axes 270. Core 224 is either disassembled or removed. In some embodiments, core 24 may remain within substrate 40. Upon completion of drum 24, the resulting channels 44 and 46 are pneumatically connected to vacuum source 26 (shown in FIG. 1). Because drum 24 and its channels 44, 46 are formed by injection molding, drum 24 is formed in less time and at a lower cost. In other embodiments, drum 24 may be formed in other fashions or the order of such steps may be varied.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:
- a drum comprising:
- a metal cylinder;
- a first polymer layer on an exterior of the cylinder;
- first channels extending into the polymer layer on an exterior of the first polymer layer;
- a second polymer layer on an interior of the cylinder and connected to the first polymer layer, and a vacuum source in pneumatic communication with the first channels;
- a print head service device; and
- an axial cavity within an interior of the cylinder and in communication with an exterior of the drum, the cavity receiving the print head service device.

2. The apparatus of claim 1 further comprising openings through the cylinder, wherein the first layer and the second layer are connected through the openings and are integrally formed as a single unitary body.

3. The apparatus of claim 1 further comprising second channels extending into the exterior of the first polymer layer, wherein the second channels are substantially perpendicular to the first channels.

4. The apparatus of claim 1, wherein the first channels have a depth of between 2 mm and 8 mm.

5. The apparatus of claim 1 further comprising:
- a sheet feeding device proximate the drum and configured to position a sheet against the drum; and
- a printing device proximate the drum and configured to deposit printing material on a sheet carried by the drum.

6. The apparatus of claim 5, wherein the printing device comprises a drop-on-demand inkjet print head.

7. The apparatus of claim 1, wherein the first polymer layer and the second polymer layer are integrally formed as a single unitary body of a single homogenous material and wherein the metal cylinder is rigid, the first metal cylinder supporting the first polymer layer and the second polymer layer in a cylindrical shape.

8. The apparatus of claim 1, wherein the first polymer layer is imperforate adjacent the metal cylinder.

9. The apparatus of claim 1, wherein the channels extend parallel to one another.

10. The apparatus of claim 1 further comprising a print device configured to print upon a print medium supported in an arc about the drum.

11. A method comprising:

providing a metal cylinder; and forming a first polymer layer on an exterior of the metal cylinder, the first polymer layer including a first channels extending into an exterior of the first polymer layer, wherein the first polymer layer is molded on the exterior of the metal cylinder;

molding a second polymer layer on an interior of the metal cylinder, wherein the cylinder includes openings extending through a wall of the cylinder and wherein the first layer and the second layer are concurrently molded on opposite sides of the wall such that the first layer and the second layer are interconnected through the openings;

pneumatically connecting vacuum source to the first channels;

positioning a core within the cylinder and spaced from the cylinder by a first gap;

positioning a plurality of die segments circumferentially about the cylinder and spaced from the cylinder by a second gap, the die segments including first channel forming projections; and injecting a polymer material into the first gap and the second gap to encapsulate the cylinder.

12. The method of claim 11 further comprising moving the die segments radially away from the cylinder.

13. The method of claim 11, wherein the cylinder includes radially extending openings and wherein the polymer material is injected through the openings to connect the first layer and the second layer.

14. The method of claim 11, wherein the die segments include second channel forming projections configured to form second channels substantially perpendicular to the first channels.

15. A method comprising:

providing a metal cylinder;

forming a first polymer layer on an exterior of the metal cylinder, the first polymer layer including a first channels extending into an exterior of the first polymer layer, wherein the first polymer layer is molded on the exterior of the metal cylinder;

positioning a core within the cylinder and spaced from the cylinder by a first gap;

positioning a plurality of die segments circumferentially about the cylinder and spaced from the cylinder by a second gap, the die segments including first channel forming projections; and injecting a polymer material into the first gap and the second gap to encapsulate the cylinder.

16. The method of claim 15 further comprising moving the die segments radially away from the cylinder.

17. The method of claim 15, wherein the cylinder includes radially extending openings and wherein the polymer material is injected through the openings to connect the first layer and the second layer.

18. The method of claim 15, wherein the die segments include second channel forming projections configured to form second channels substantially perpendicular to the first channels.

19. An apparatus comprising:

a drum comprising:

a metal cylinder;

a first polymer layer on an exterior of the cylinder;

first channels extending into the polymer layer on an exterior of the first polymer layer; and a second polymer layer on an interior of the cylinder and connected to the first polymer layer;

a print device configured to print upon a print medium supported in an arc about the drum; a print head service device; and an axial cavity within an interior of the cylinder and in communication with an exterior of the drum, the cavity receiving the print head service device.

* * * * *